US008087398B2

(12) United States Patent
Harvey et al.

(10) Patent No.: US 8,087,398 B2
(45) Date of Patent: Jan. 3, 2012

(54) FUEL SYSTEM FOR A DIRECT INJECTION INTERNAL COMBUSTION ENGINE

(75) Inventors: William T. Harvey, Brighton, MI (US); Steven J. Miller, Livonia, MI (US); Hiroaki Saeki, West Bloomfield, MI (US)

(73) Assignee: Hitachi Automotive Systems Americas Inc., Harrodsburg ( * ) Notice: Subject to any disclaimer, the term of this patent is extended or adjusted under 35 U.S.C. 154(b) by 318 days.

(21) Appl. No.: 12/476,311

(22) Filed: Jun. 2, 2009

(65) Prior Publication Data

US 2010/0300409 A1 Dec. 2, 2010

(51) Int. Cl.
*F02M 61/14* (2006.01)
*F02M 61/18* (2006.01)

(52) U.S. Cl. ..... 123/470; 123/456

(58) Field of Classification Search ..... 123/470, 123/456, 447, 468, 469; 239/600
See application file for complete search history.

(56) References Cited

U.S. PATENT DOCUMENTS 4,203,402 A * 5/1980 Freyn ..... 123/470
6,840,227 B2 * 1/2005 Reiter et al. ..... 123/470
7,461,638 B2 * 12/2008 Scheffel et al. ..... 123/470
7,861,692 B2 * 1/2011 Biasci et al. ..... 123/470
7,874,282 B2 * 1/2011 Ghelardi et al. ..... 123/470
2004/0040543 A1 * 3/2004 Mickelson ..... 123/470
2005/0278917 A1 * 12/2005 Klann ..... 29/214
2007/0221176 A1 * 9/2007 Hardy ..... 123/470

OTHER PUBLICATIONS

Non-Isolated Fuel System Rails, Prior Art for Hitachi Automotive Products Patent Application Presentation by Steve Miller dated Feb. 10, 2010, 4 pages.

* cited by examiner

*Primary Examiner* — Mahmoud Gimie
(74) *Attorney, Agent, or Firm* — Gifford, Krass, Sprinkle, Anderson & Citkowski, P.C.

(57) ABSTRACT

A fuel system for a direct injection engine having a fuel rail and a plurality of direct injection fuel injector assemblies mounted to the fuel rail. Each fuel injector assembly includes a mounting surface and a dampener made of a resilient material is disposed around this mounting surface. A bracket is secured to the engine and has a recess for each fuel injector assembly. Each fuel injector assembly is positioned in its associated recess so that at least a portion of the dampener is sandwiched between the fuel injector assembly mounting surface and a complementary mounting surface formed on the recess. A holder secures the injector assembly in its associated recess.

11 Claims, 2 Drawing Sheets

FUEL SYSTEM FOR A DIRECT INJECTION INTERNAL COMBUSTION ENGINE

BACKGROUND OF THE INVENTION

I. Field of the Invention

The present invention relates generally to direct injection internal combustion engines and, more particularly, a fuel system for a direct injection internal combustion engine.

II. Description of Material Art

Direct injection internal combustion engines are becoming increasingly popular in the automotive industry. This increase in popularity results in large part from the fuel economy and engine operating efficiency of direct injection internal combustion engines.

One disadvantage, however, of direct injection internal combustion engines is that such engines require fuel to be delivered to the fuel rail and the fuel injectors at a very high pressure in order to overcome the pressures present in the interior combustion chamber of the engine. In order to achieve these high pressures, a cam driven pump is oftentimes used to pressurize the fuel rail.

Such fuel pumps, however, can cause the fuel rail to vibrate due to the high pressure pulsations produced by the cam driven fuel pump. These vibrations, furthermore, may result in undesirable engine noise, particularly where metallic parts of the fuel system contact and vibrate against other metallic components of the engine or fuel system.

SUMMARY OF THE PRESENT INVENTION

The present invention provides a fuel system for a direct injection internal combustion engine which overcomes the above-mentioned disadvantages of the previously known engines.

In brief, the fuel system of the present invention comprises a fuel rail having at least one direct injection fuel injector assembly connected to the rail at spaced locations there along. Typically, one fuel injector is provided for each internal combustion chamber.

Each fuel injector assembly includes a mounting surface formed around its outer periphery. A dampener constructed of a resilient material is disposed within the fuel injector assembly mounting surface.

A bracket is secured to the engine and includes a recess for each fuel injector assembly. Each fuel injector assembly is positioned within its associated recess so that at least a portion of the dampener is sandwiched between the fuel injector assembly mounting surface and a complementary mounting surface formed along the recess.

A holder is then attached to the bracket for each recess which locks the fuel injector assembly associated with that recess to the bracket. Preferably, the holder includes a mounting surface which is complementary to the fuel injector assembly mounting surface so that a portion of the dampener is sandwiched in between the mounting surfaces on the holder and fuel injector assembly.

In operation, the resilient dampeners mechanically isolate the fuel rail and fuel injector assemblies from the bracket. This, in turn, reduces engine noise.

BRIEF DESCRIPTION OF THE DRAWING

A better understanding of the present invention will be had upon reference to the following detailed description when read in conjunction with the accompanying drawing, wherein like referenced characters refer to like parts throughout the several views, and in which.

DETAILED DESCRIPTION OF PREFERRED EMBODIMENTS OF THE PRESENT INVENTION

Figure 1:
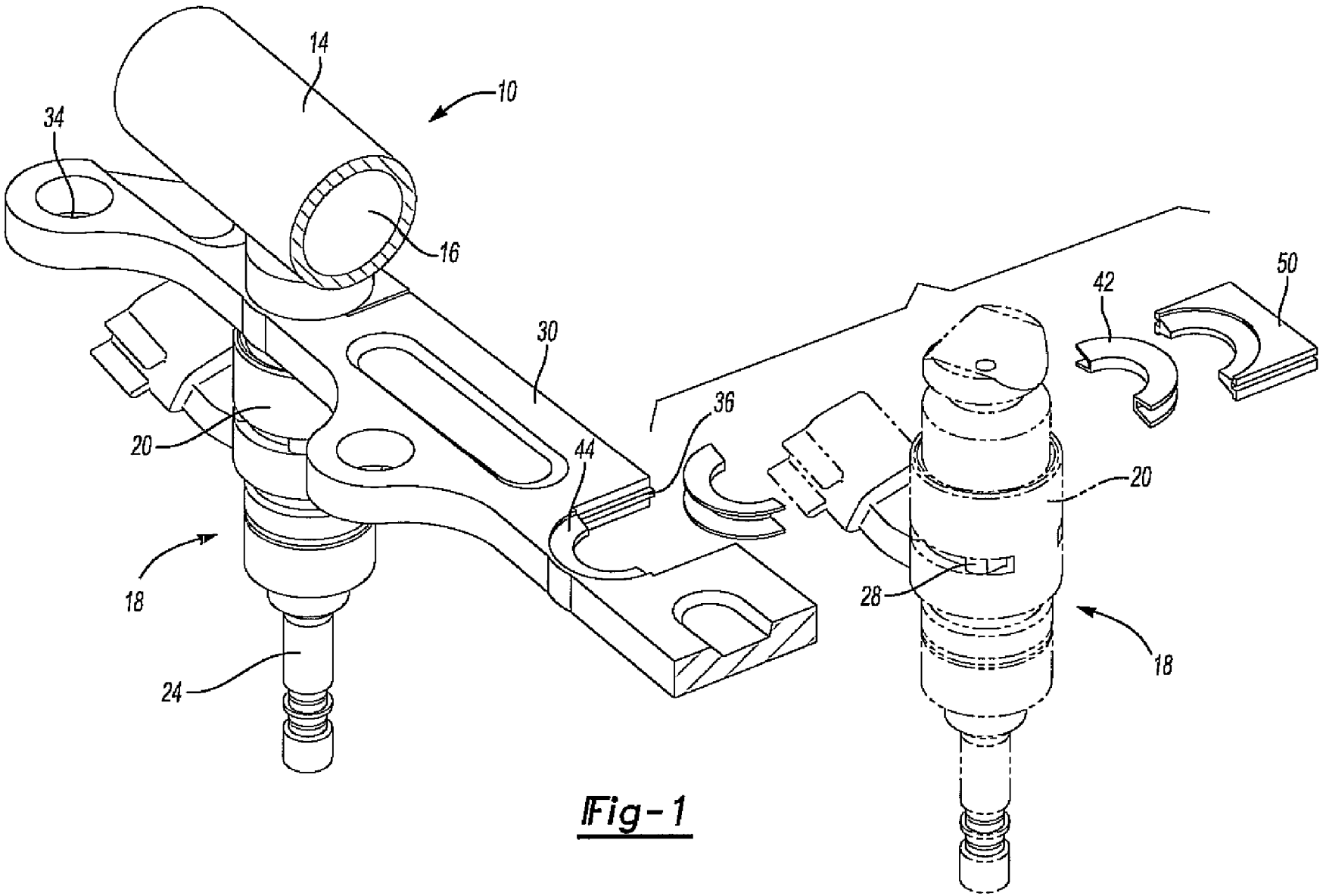
FIG. 1 is an elevational and partially exploded view illustrating a preferred embodiment of the present invention.
Figure 2:
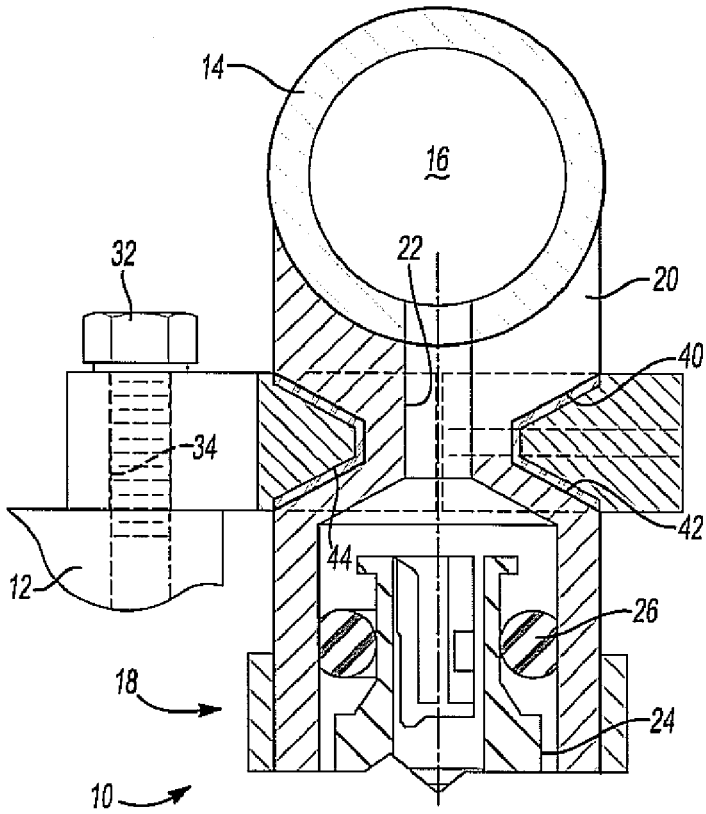
FIG. 2 is a fragmentary longitudinal sectional view of the preferred embodiment of the invention.

With reference first to FIGS. 1 and 2, a fuel system 10 for a direct injection internal combustion engine 12 is shown. The fuel system 10 includes an elongated fuel rail 14 having an interior chamber 16 which is supplied with pressurized fuel from a fuel pump (not shown).

A plurality of fuel injector assemblies 18 are mounted to the fuel rail 16 at spaced positions there along. Although the fuel injector assembly 18 may take different forms, as shown each fuel injector assembly 18 includes a fuel cup 20 which is attached to the fuel rail 14 and fluidly connected to the fuel rail chamber 16 by a fluid passageway 22 (FIG. 2).

The fuel cup 20 is open at its lower end and axially slidably receives a direct injection fuel injector 24 within its interior.

A seal 26 fluidly seals the fuel injector 24 to the cup 20 so that fuel from the fuel rail 14 flows through the passageway 22, into the fuel cup 20 into the fuel injector 24. Any means, such as a clip 28, may be used to secure the fuel cup 20 to the fuel injector 24.

With reference still to FIGS. 1 and 2, an elongated bracket 30 is mounted to the engine 12 by fasteners 32 which extend through bracket mounting holes 34 and into the engine 12. The bracket 30 also includes a plurality of generally U-shaped recesses 36 wherein one recess 36 is associated with each fuel injector assembly 18.

Figure 3:
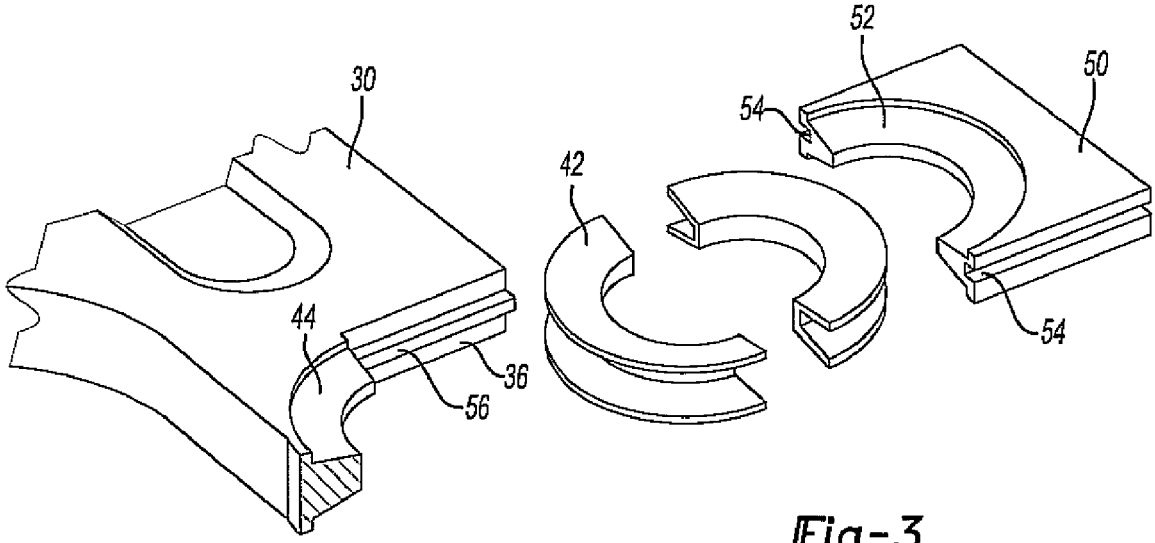
FIG. 3 is a fragmentary exploded view illustrating a portion of the preferred embodiment of the invention.

With reference now to FIGS. 2 and 3, a generally V-shaped mounting surface 40 is formed on the fuel injector assembly 18 so that the mounting surface 40 extends radially inwardly around the fuel injector assembly 18. As best shown in FIG. 2, this fuel injector mounting surface 40 is formed in the fuel cup 20 adjacent the fuel rail 14.

Figure 4:
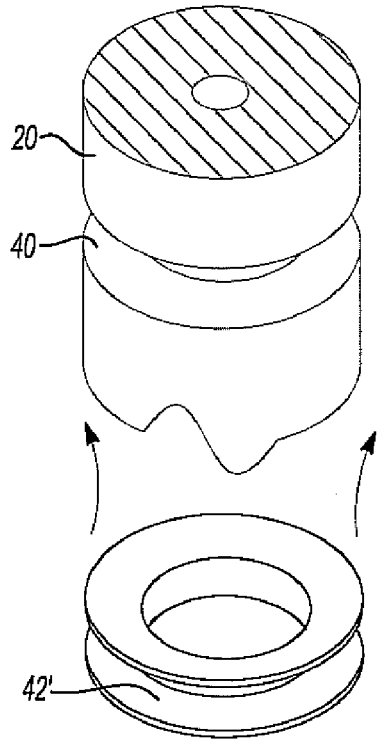
FIG. 4 is a fragmentary exploded view illustrating a modification of the preferred embodiment of the invention.

A dampener 42 made of a resilient material, such as an elastomeric material or the like, is provided around the fuel injector mounting surface 40. This dampener 42, furthermore, may be either of a two-piece construction, as illustrated in FIG. 3, or a one-piece construction, as illustrated at 42' in FIG. 4.

With reference to FIGS. 1-3, each recess 36 in the mounting bracket 30 includes a mounting surface 44 which is complementary in shape to the mounting surface 40 on the fuel injector assembly 18. Consequently, with the fuel injector assembly 18 positioned within its associated recess 36, a portion of the dampener 42 is sandwiched in between the mounting surface 40 on the fuel injector assembly and the mounting surface 42 on the bracket 30. As shown in the drawing, the mounting surface 44 on the bracket 30 extends around approximately one-half of the fuel injector assembly 18.

With the fuel injector assembly 18 positioned in its associated recess 36, a holder 50 is associated with each recess 36 to lock the fuel injector assembly in its associated recess. Preferably, the holder 50 includes a mounting surface 52 which is also complementary in shape to the fuel injector assembly mounting surface 40. Consequently, with the holder 50 slid into the open end of the recess 36, a portion of the dampener 40 is sandwiched in between the holder mounting surface 52 and the fuel injector assembly mounting surface 40. Any conventional means, such as staking, adhesive, soldering, welding, or the like may be used to secure the holder 50 in position on the bracket 30.

Although the holder 50 may take many forms, as illustrated, a slide 54 is provided on each side of the holder 50. This slide 54 cooperates with rails 56 formed on both sides of the recess 36 so that the holder 50 may be easily slid into its associated recess 36 and against its associated fuel injector assembly.

In operation, the dampener 42 isolates the bracket 30 from the fuel system 10 and prevents the transmission of vibrations from the fuel system 10 to the engine 12 via the bracket 30. This, in turn, reduces engine noise, particularly at low speeds, such as idle.

Having described our invention, it can be seen that the present invention provides a simple and yet highly effective method for reducing engine noise in a direct injection internal combustion engine. Having described our invention, however, many modifications thereto will become apparent to those skilled in the art to which it pertains without deviation from the spirit of the invention as defined by the scope of the claims.

We claim:

1. A fuel system for a direct injection internal combustion engine comprising:

an elongated fuel rail, a plurality of direct injection fuel injector assemblies connected to said fuel rail at spaced intervals therealong, each fuel injector assembly having a mounting surface, an elongated bracket secured to the engine, said bracket having a U-shaped recess with an open end for each fuel injector assembly, each U-shaped recess having a mounting surface at its end opposite said open end of said bracket and which is complementary in shape to a first portion of said fuel injector mounting surface, at least one dampener constructed of a resilient material, each said fuel injector assembly being positioned in its associated bracket recess so that at least a portion of said dampener is sandwiched between said fuel injector assembly mounting surface and said recess mounting surface, and a plurality of holders, one holder associated with each bracket recess, each holder having a mounting surface complementary in shape to a second portion of said fuel injector mounting surface, said holder being insertable into its associated recess to thereby sandwich said at least one dampener between said holder mounting surface and said second portion of said fuel injector mounting surface and said holder mounting surface and simultaneously secure its associated fuel injector assembly to said bracket in its associated recess.

2. The fuel system as defined in claim 1 wherein a slide is formed on one of said bracket around said recess and said holder and a cooperating rail is formed on the other of said bracket around said recess and said holder.

3. The fuel system as defined in claim 1 wherein said holder is fixedly secured to said bracket.

4. The fuel system as defined in claim 1 wherein said dampener is a one piece construction and extends entirely around said fuel injector assembly.

5. The fuel system as defined in claim 1 wherein said dampener comprises two separable parts, one said part being positioned between said recess mounting surface and said fuel injector assembly mounting surface and the other said part being positioned between said holder mounting surface and said fuel injector assembly mounting surface.

6. The fuel system as defined in claim 1 wherein said fuel injector assembly mounting surface is V-shaped in cross section.

7. The fuel system as defined in claim 6 wherein said fuel injector assembly mounting surface is recessed radially inwardly into said fuel injector assembly.

8. The fuel system as defined in claim 6 wherein said recess mounting surface is V-shaped in cross section.

9. The fuel system as defined in claim 1 wherein said holder mounting surface is V-shaped in cross section.

10. The fuel system as defined in claim 6 wherein said fuel injector assembly mounting surface is recessed radially inwardly into said fuel injector assembly.

11. The fuel system as defined in claim 1 wherein said fuel injector assembly comprises a fuel cup attached to said fuel rail and a fuel injector positioned within said cup, said fuel injector assembly mounting surface being formed in said fuel cup adjacent said fuel rail.

* * * * *

UNITED STATES PATENT AND TRADEMARK OFFICE

CERTIFICATE OF CORRECTION

PATENT NO. : 8,087,398 B2
APPLICATION NO. : 12/476311
DATED : January 3, 2012
INVENTOR(S) : William T. Harvey et al.

It is certified that error appears in the above-identified patent and that said Letters Patent is hereby corrected as shown below:

Column 2, line 1, delete “drawing”, insert --drawings--.

Column 2, line 51, delete “42”’, insert --42--.

Signed and Sealed this
Twenty-fifth Day of September, 2012

David J. Kappos

David J. Kappos
*Director of the United States Patent and Trademark Office*